US005498316A

United States Patent [19]

Kraft

[11] Patent Number: 5,498,316

[45] **Date of Patent: *Mar. 12, 1996**

[54] TWIN WIRE FORMER FOR A PAPER MAKING MACHINE

[75] Inventor: Wilfried Kraft, Heidenheim, Germany

[73] Assignee: J. M. Voith GmbH, Germany

[21] Appl. No.: 186,325

[22] Filed: Jan. 25, 1994

[ * ] Notice: The term of this patent shall not extend beyond the expiration date of Pat. No. 5,300,196.

Related U.S. Application Data

[63] Continuation of Ser. No. 889,677, May 28, 1992, Pat. No. 5,300,196.

[30] Foreign Application Priority Data

May 29, 1991 [DE] Germany ..... 41 17 597.2

[51] Int. Cl.[6] ..... D21F 1/00

[52] U.S. Cl. ..... 162/301; 162/273; 162/300

[58] Field of Search ..... 162/300, 301, 162/273, 274

[56] References Cited

U.S. PATENT DOCUMENTS

| | | | |
|---|---|---|---|
| 3,846,232 | 3/1973 | Kankaanpaa | 162/301 |
| 4,033,812 | 7/1977 | Riihinen | 162/273 |
| 4,544,447 | 10/1985 | Pinter et al. | 162/301 |
| 4,735,686 | 4/1988 | Skytta | 162/301 |
| 4,790,909 | 12/1988 | Harwood | 162/352 |
| 4,894,120 | 1/1990 | North | 162/301 |
| 4,919,762 | 4/1990 | Laapotti et al. | 162/273 |
| 4,960,492 | 10/1990 | Weitzel et al. | 162/301 |
| 5,074,964 | 12/1991 | Partanen | 162/300 |
| 5,141,600 | 8/1992 | Meinecke et al. | 162/300 |
| 5,167,770 | 12/1992 | Bubik et al. | 162/301 |

FOREIGN PATENT DOCUMENTS

| | | | |
|---|---|---|---|
| 2012251 | 3/1990 | Canada . | |
| 91/02842 | 3/1991 | WIPO | 162/300 |

OTHER PUBLICATIONS

Speed–Former HS The New Roll and Blade Former in Operation—1988 Annual Meeting Technical Section, CPPA Montreal, Canada.

*Primary Examiner*—Karen M. Hastings
*Attorney, Agent, or Firm*—Ostrolenk, Faber, Gerb & Soffen

[57] ABSTRACT

A twin-wire former for a paper machine having two endless loop wires, a wire support frame and a head box. The web forming zone leading from the entrance slot, which is at the breast roll in one wire loop and the forming roll in the other wire loop, is inclined at an angle of 30° to 50° to the horizontal. The wire support frame has the shape of an inverted U with a front support arranged upstream of the head box, a rear support arranged downstream of the head-box and an upper beam which connects the upper ends of the front and rear supports to each other. A lower beam is located within the loop of the lower wire and extends to both of the forward and rearward sides of the rear support with one end extending into the U-shaped frame while the other end extends at least approximately up to the remote end of the loop of the lower wire. At least one water removal element of the upper wire is suspended from the upper beam. At least one water removal element of the lower wire rests on the lower beam.

18 Claims, 1 Drawing Sheet

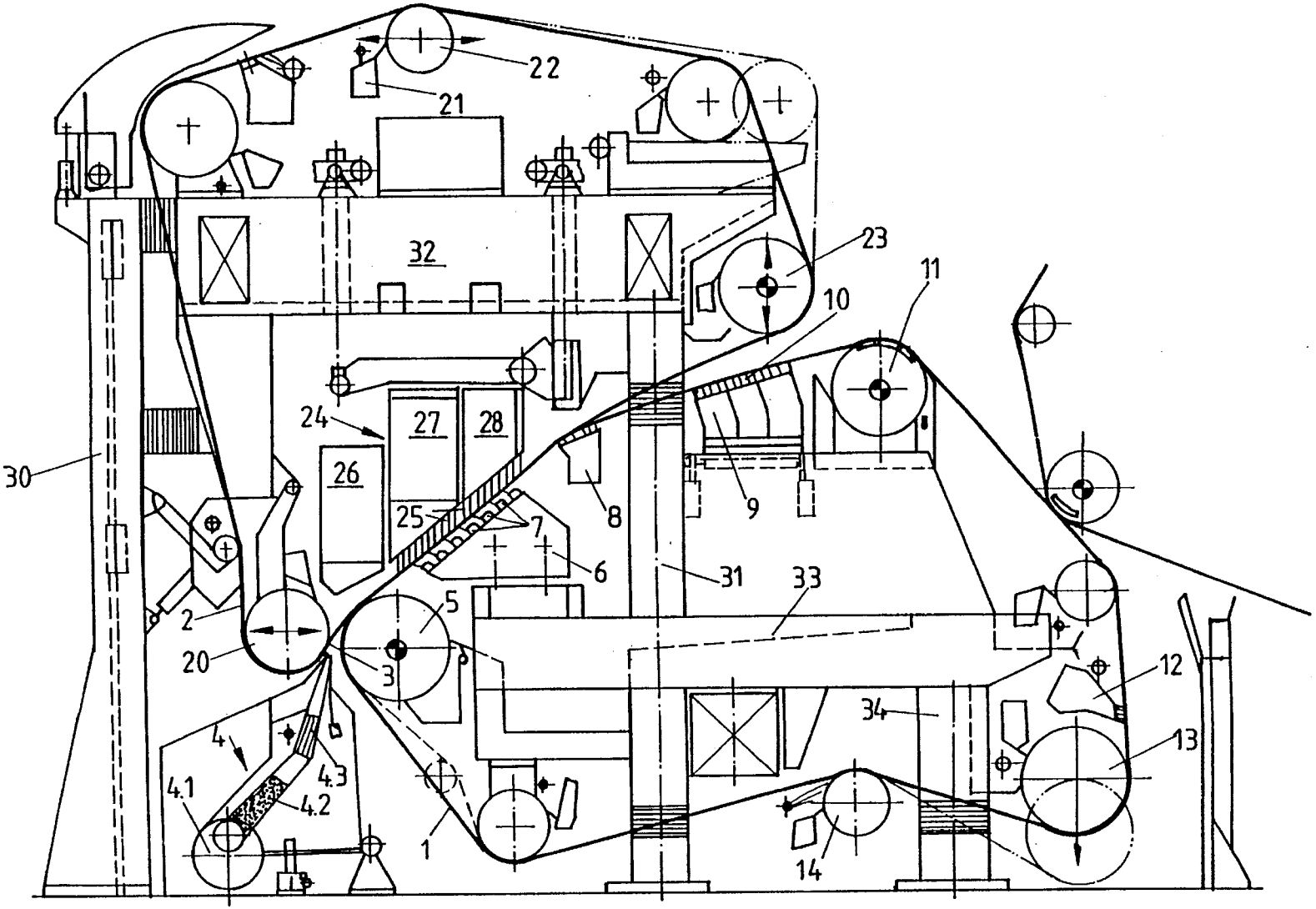
1
2
3
4
4.1
4.2
4.3
5
6
7
8
9
10
11
12
13
14
20
21
22
23
24
25
26
27
28
30
31
32
33
34

TWIN WIRE FORMER FOR A PAPER MAKING MACHINE

This is a continuation of application Ser. No. 07/889,677, filed May 28, 1992, now U.S. Pat. No. 5,300,196.

BACKGROUND OF THE INVENTION

The present invention relates to a twin-wire former for a paper making machine. Each wire is an endless loop screen onto which pulp suspension from a headbox is directed. A twin-wire former has two wires and the pulp suspension is sandwiched between the wires.

Numerous twin wire formers for paper machines are known, and they include many modifications. Reference may be had to a number of publications:

(1) Federal Republic of Germany 39 10 892 A 1 describes a twin-wire former which contains several known features. The wire support frame is not shown in the reference. But, it is present, as a person skilled in the art knows. The forming roll which is located at the beginning of the forming or wire section has a perforated roll jacket. The web forming zone has a first curved section. A plurality of transverse ledges, which extend transversely to the direction of travel of the lower wire, are arranged within the lower wire loop. Water removal elements are also present within the upper wire loop. The web forming zone extends at a slight angle to the horizontal.

(2) Federal Republic of Germany 39 27 597 A 1 describes several variants of twin-wire formers. In the variant shown in FIG. 1, the web forming zone also has the shape of a circular arc with a very large radius of curvature. The initial region of the web forming zone is also slightly inclined to the horizontal. In the variants shown in FIGS. 2 and 3, the web forming zone rises substantially vertically.

(3) U.S. Pat. No. 3,846,232 describes a twin-wire former having a head box, and the outlet channel of the headbox rises at an angle of about 30° to the horizontal. The jet of pulp is sandwiched between two forming wires which wrap around a forming roll, and the wires leave the forming roll, together with the fiber web between them, at an angle of about 30° to the vertical. The web forming zone thus rises very rapidly from that point.

(4) The "Speed-Former HS" article from the 1988 annual meeting technical section, CPPA, describes a twin-wire former in which the jet of pulp, similar to Reference (3) above, is injected obliquely from below into the entrance slot between two wires and in which the two wires with the web present between them leave the forming roll at a rather steep angle. The reference shows a part of the wire frame which comprises horizontal beams and vertical supports.

A twin-wire former must satisfy numerous requirements. It must form a good web or sheet, i.e. the sheet should be of perfect quality with regard, for instance, to fiber distribution, cloudiness, as well as having uniform basis weight over the width. These requirements relate to the paper which is to be produced. Other requirements concern the construction of the machine. Thus, the twin-wire former should be as simple as possible in construction in order to keep its manufacturing costs low. It is further important that the twin-wire former be developed favorably for performing its functions. In this connection, it is important, for instance, that the large amount of water which emerges from the web be led away dependably and reliably. The wires must be able to be easily and well cleaned. They should be subject to the smallest possible amount of wear so that they are capable of removing water even after prolonged use.

The comfort of operation of the twin-wire former is particularly important. The twin-wire former should be developed so that the paper making machine crew can easily and rapidly take all necessary steps and so that the fewest number of people is required for machine operation. Thus, the water removal elements should be easily accessible, so that they can also be easily replaced or adjusted. This is specifically not true of known twin-wire formers. The head box is continuously subject to dirtying. Because it is an important part of the paper making machine, the headbox must be cleaned regularly. In this connection, it is desirable to arrange the headbox so that it is less subject to dirt and so that it furthermore is easily accessible for cleaning and other servicing.

Another very important requirement is that the dimensions of the twin-wire former, including the headbox, be kept as small as possible. In this connection, furthermore, the possibility of expansion must be borne in mind.

Known twin-wire formers have in each case satisfied one or more of these requirements. In this connection, however, it has often been found that it is difficult to satisfy all of the above objectives. In particular, the requirement as to the space taken up has not been sufficiently handled.

SUMMARY OF THE INVENTION

The objects of the present invention are to develop a twin-wire former that satisfies all of the stated requirements, i.e. it forms a good web or sheet, it properly performs its functions, particularly with regard to the removal of water and the cleaning of the wires, it is easy to service and, in particular, its critical parts are easily accessible, and it has relatively small dimensions.

The objects are achieved by the invention.

Both of the lower and upper wires of the twin-wire former are in endless loop form. A frame includes support means that support both wire loops. The wires are supported to define a web forming zone which starts at an entrance slot defined by a forming roll in the lower wire loop and a breast roll in the upper wire loop. A headbox directs pulp upward and into the entrance slot.

a) The web forming zone is inclined upward from the horizontal leading away from the entrance slot. The selected angle of incline of 30° to 50° to the horizontal represents an optimum with respect to the utilization of the space and the formation of the web. The oblique ascent of the web forming zone saves some length of the web former, and instead takes up some height which, however, is generally available. On the other hand, the influence of the force of gravity, which exists with horizontal web forming zones and which favors undesired two-sidedness, is reduced.

b) The support frame has a front beam upstream of the headbox, a rear beam to the rear of the headbox and an upper beam joining the top ends of the front and rear beams to define an inverted U. The special development of the frame as described in detail below, permits particularly optimal utilization of the available space.

A lower beam passes from in front of to the rear of the rear support.

c) The suspension or hanging of water removal elements for the upper wire from the upper beam and the support of water removal elements for the lower wire on the lower beam are important for the optimum utilization of space. In a further development, the main body of the headbox, as well, as the main part of the web forming zone, very roughly form a diagonal which is present in the U-shaped wire frame and which extends practically from the one lower corner of the U-shaped frame to the opposite upper corner.

BRIEF DESCRIPTION OF THE DRAWING

Other objects and features of the invention are explained with reference to the drawing which is a somewhat schematic side elevational view of a twin-wire forming section.

DESCRIPTION OF THE PREFERRED EMBODIMENT

The illustrated twin wire former for a paper making machine has two endless loop, forming wire screens or wires 1, 2, i.e. a lower wire 1 and an upper wire 2. Each of the wires forms a respective separate closed loop. The wires have a run together over a forming zone where they sandwich pulp between them to form a web. The wires 1, 2 are directed to form a wedge shaped entrance slot 3 between them for receiving sprayed in pulp suspension. In front of the entrance slot, there is a headbox 4, discussed further below. Both wires 1 and 2 wrap around a number of rolls and other elements which guide the wires along respective paths and tension them.

Important parts enclosed in the loop of the lower wire 1 include along the path of the wire 1 a forming roll 5, which helps define the entrance slot 3, a known non-suction water removal unit 6 below the upper run of the wire 1, known water removal ledges 7, a suction separator 8 which draws the web to the lower wire as the wires 1 and 2 separate, another water removal body 9 below the upper run of the wire 1, and including known water removal ledges 10, a wire suction roll 11, a blow nozzle 12, as well as wire tensioning rolls 13 and 14. The rolls and other elements contacting the lower wire loop define respective support means for the lower wire. They are directly or indirectly supported on the frame which is described below. Further installation elements or accessories can be noted which, however, are of less importance in this connection.

Important parts are also enclosed in the loop of the upper wire 2. These include a breast roll 20 which cooperates with the forming roll 5 in the lower wire loop to define the web entrance slot 3. Both the forming and breast rolls 5, 20 have respective axes which are parallel and are preferably in a horizontal plane. There is a blow nozzle 21. There are a shiftable tensioning roll 22 and another shiftable tensioning roll 23 which are movable to adjust the tension on the upper wire 2. The rolls and other elements contacting the upper wire loop define respective support means for the upper wire. They are directly or indirectly supported on the frame which is described below. There is also a suction water removal unit 24, which includes a plurality of water removal ledges 25 for removing water from the top side of the lower run of the wire 2, and a skimmer 26, a first suction zone 27, and a second suction zone 28. Individually, these features are all known in the prior art, but are not known to the prior art in the combination illustrated in the drawing hereof and described herein.

The wire supporting frame has essentially the shape of an inverted U. It comprises a front support 30 at the upstream or headbox side of the frame, a rear support 31 spaced downstream from the front support and an upper beam 32 at and extending between the top ends of the two supports. Such a frame is arranged on both lateral sides of the machine, i.e. on the operator side and on the driven side. In the present drawing, only one of these two frames can be noted.

The frame further comprises a lower beam 33. As seen in this side view, the lower beam extends beyond both the front and rear sides of the rear support 31. To the front or left in the drawing, it extends into the space which is defined by the U-shaped frame. To the rear or right, the beam 34 extends far beyond the frame, up to about the rear end of the loop path of the lower wire 1. In this end region, the lower beam is supported by another support 34.

The water removal unit 6 which is associated with the lower wire 1 is supported by the front end of the beam 33. The water removal unit 24 associated with the upper wire 2 is suspended from the beam 32. This contributes to optimum utilization of available space.

Formation of the web commences at the wedge shaped entrance slot 3, where the two wires 1 and 2 are first brought together. Therefore, it takes place on the forming roll 5. In the following the expression web forming zone means substantially that region of the two wires 1 and 2 which extends between the point where these two wires move off from the forming roll 5 and the point where they move onto the suction separator 8.

For enabling introduction of the two wires 1 and 2 into the frame, the supports 30, 31, 34 and possibly also the beam 32, are provided with removable sections, illustrated there by groups of the close, parallel line sections at and in the supports.

The headbox 4 is of known construction. It comprises an initial distributor 4.1 which extends transversely to the direction of travel of the wires and further comprises successive tube nest sections 4.2 and 4.3, of a type know in the art. The headbox includes a pulp outlet nozzle which directs pulp suspension into the entrance slot 3. At least the outlet nozzle, if not the entire headbox, extends across the entire width of the machine and of the wires 1, 2. The main part of the headbox, namely the tube nest sections 4.2 and 4.3, as well as the web forming zone extend along the water removal ledges 7 and the water removal ledges 25. This path is very roughly along a diagonal which approximately connects the left lower corner of the U-shaped frame with the right upper corner of that frame. The path of the web forming zone is inclined up from the horizontal at an angle of 30° to 50°. To best deliver pulp suspension into the entrance slot 3, the nozzle outlet of the headbox is inclined at an angle of 0° to 20° to the vertical. Therefore, the pulp flow is initially primarily directed at the upper wire at the entrance slot. The main body of the headbox near its nozzle extends at an angle which is approximately in the direction of the web forming zone. In this connection, the start of the web forming zone and thus the start of the water removal ledges 7, 25 are located at least approximately in the central region of the area defined by the U-frame 30, 31, 32. That arrangement is particularly economical with respect to space. At the same time, it is optimal with respect to the manner of operation of the entire paper making plant, as well as optimally easing operation. The head box 4.1 is well protected from dirt in the form of pulp suspension which is splattered around. The reason for this is that the head box 4.1 is on one side of a vertical plane through the forming roll 5, while the web forming zone is on the other side of that plane.

There is sufficient space in the region of the web forming zone for the large amount of water which emerges toward both sides of the two wires from the fiber web being produced. The lower beam 33 extends into the space defined by the U-frame only to the extent necessary for the beam 33 to support the lower water removal unit 6. The suspension of the upper water removal unit 24 from the upper beam 32 avoids the need for any other supports or beams which take up valuable space within the frame. Furthermore, this enables good access to the critical parts, namely to the water removal units 6 and 24.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A twin wire former for a paper making machine including:

a support frame;

lower wire support means supported on the frame, and an endless loop lower wire supported on the lower wire support means for movement along a path that defines a lower loop;

upper wire support means supported on the frame, and an endless loop upper wire supported on the upper wire support means for movement along a path that defines an upper loop;

the lower wire support means including a forming roll disposed in the lower loop and the upper wire support means including a breast roll disposed in the upper loop;

the upper and lower wire support means being operatively positioned and cooperating to form a generally wedge shaped entrance slot for pulp suspension between upwardly moving portions of both the lower and upper wires, and said entrance slot extending upstream from the breast and forming rolls;

a headbox for supplying a pulp suspension to said entrance slot;

the lower and upper wire support means being operatively positioned and cooperating to define a forming zone between the lower and upper wires, said forming zone extending downstream from the entrance slot, and the upper and lower wire support means directing the wires to separate downstream of the forming zone;

an upper water removal device including a suction portion in said upper loop to receive water from said upper wire as it moves through said forming zone;

a lower water removal device in said lower loop to receive water from said lower wire as it moves through said forming zone;

said lower water removal device being in proximity to said forming roll and downstream thereof, without any portions of said lower support means being interposed between said lower water removal device and said forming roller;

said frame including an inverted U-shaped portion that defines an area;

said headbox being disposed within said area and said forming zone being located in a central region of said area.

2. A twin wire former as defined by claim 1 in which said lower wire support means includes a suction box disposed within said lower loop and downstream of said lower water removal device in the vicinity of that location where said wires begin to separate downstream of the forming zone.

3. A twin wire former as defined by claim 1 wherein said forming and breast rollers have respective first and second horizontal axes positioned in horizontal planes that are close to one another.

4. A twin wire former as defined by claim 2 wherein said forming and breast rollers have respective first and second horizontal axes positioned in horizontal planes that are close to one another.

5. A twin wire former as defined by claim 2 also including another water removal device within the lower loop being disposed near said suction box and downstream thereof.

6. A twin wire former as defined by claim 2 in which said headbox includes an output nozzle that is aimed at said entrance slot, being sloped at a vertical angle in a range of approximately 0° to 20°.

7. A twin wire former as defined by claim 6 in which a substantial portion of the headbox extends toward the forming zone.

8. A twin wire former as defined by claim 1 in which within said forming zone, both said upper wire and said lower wire move downstream and diagonally upward.

9. A twin wire former as defined by claim 1 in which said area includes a lower upstream corner and a diagonally opposite upper downstream corner; and within said forming zone both said upper wire and said lower wire move downstream and diagonally upward in a path segment that is along a diagonal line that extends generally from said lower upstream corner to said upper downstream corner.

10. A twin wire former as defined by claim 9 wherein said diagonal line is inclined in a range of between 30° to 50°.

11. A twin wire former as defined by claim 1 in which said frame comprises a vertical section that includes a first removable section which when removed provides a space in said first vertical section that is operatively positioned to permit passage therethrough of both said upper and lower wires for removal and replacement thereof.

12. A twin wire former as defined by claim 11 in which said vertical section also includes another removable section which when removed provides another space in said vertical section that is operatively positioned to permit passage therethrough of said lower wire for removal and replacement thereof;

said another space being below said space.

13. A twin wire former as defined by claim 1 in which said inverted U-shaped portion of said frame comprises a horizontal section and first and second vertical sections extending downward from said horizontal section;

said first vertical section including a first removable section which when removed provides a space in said first vertical section that is operatively positioned to permit passage therethrough of both said upper and lower wires for removal and replacement thereof.

14. A twin wire former as defined by claim 13 in which said forming zone includes a downstream end in the vicinity of said first removable section of said first vertical section.

15. A twin wire former as defined by claim 14 in which said first vertical section also includes another removable section which when removed provides another space in said vertical section that is operatively positioned to permit passage therethrough of said lower wire for removal and replacement thereof;

said another space being below said space.

16. A twin wire former as defined by claim 13 in which said upper water removal device is suspended from said horizontal section of said inverted U-shaped portion of said frame.

17. A twin wire former as defined by claim 14 in which said upper water removal device is suspended from said horizontal section of said inverted U-shaped portion of said frame.

18. A twin wire former as defined by claim 15 in which said upper water removal device is suspended from said horizontal section of said inverted U-shaped portion of said frame.

* * * * *